US009020153B2

(12) United States Patent
Britt, Jr.

(10) Patent No.: US 9,020,153 B2
(45) Date of Patent: Apr. 28, 2015

(54) AUTOMATIC DETECTION OF LOUDSPEAKER CHARACTERISTICS

(71) Applicant: Google Inc., Mountain View, CA (US)

(72) Inventor: Joe Freeman Britt, Jr., Los Altos, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 13/659,529

(22) Filed: Oct. 24, 2012

(65) Prior Publication Data

US 2014/0112484 A1 Apr. 24, 2014

(51) Int. Cl.
*H04R 29/00* (2006.01)
*H04S 7/00* (2006.01)

(52) U.S. Cl.
CPC ..... *H04R 29/001* (2013.01); *H04S 7/308* (2013.01)

(58) Field of Classification Search
CPC ..... H04R 29/00; H04R 29/001; H04R 5/04; H04R 2420/07; H04R 3/12; H04R 3/00; H04R 2499/13; H04R 2420/05; H04R 2499/11; H04R 3/007
USPC ..... 381/58, 59, 77
See application file for complete search history.

(56) References Cited

U.S. PATENT DOCUMENTS

| | | | | |
|---|---|---|---|---|
| 6,859,538 | B1 * | 2/2005 | Voltz | 381/77 |
| 7,099,481 | B2 | 8/2006 | Baker et al. | |
| 8,189,816 | B2 | 5/2012 | Solow | |
| 2005/0175195 | A1 | 8/2005 | Cheney et al. | |
| 2007/0142942 | A1 | 6/2007 | Hyatt | |
| 2008/0318629 | A1 | 12/2008 | Inha et al. | |
| 2009/0269036 | A1 | 10/2009 | Mitani et al. | |
| 2011/0002471 | A1 * | 1/2011 | Wihardja et al. | 381/56 |
| 2011/0033056 | A1 | 2/2011 | Johnson et al. | |
| 2012/0201393 | A1 | 8/2012 | Cheek et al. | |

FOREIGN PATENT DOCUMENTS

| | | |
|---|---|---|
| KR | 1020100003811 | 1/2010 |
| WO | 0119060 | 3/2001 |

OTHER PUBLICATIONS

ISR and Written Opinion for PCT/US2013/065886, mailed Jan. 22, 2014.

* cited by examiner

*Primary Examiner* — Paul S Kim
(74) *Attorney, Agent, or Firm* — Morris & Kamlay LLP

(57) ABSTRACT

Disclosed is subject matter that proposes a system and method for a media device to automatically detect the characteristics of an attached speaker. Speakers have many different characteristics, for example, power, impedance, frequency response, etc. With knowledge of the speaker characteristics, audio output can be equalized appropriately, and an amplifier of the media device, for example, can prevent exceeding the maximum power handling capability of the speaker. Described is a device and method for retrieving information about the speaker from a memory that is coupled to the speaker. A media device can read the data from the memory over existing speaker wires. Software and/or hardware in the media device can optimize the output to the attached speaker. Accordingly, the media device can interrogate the speaker directly over speaker wire to obtain the characteristics of the speaker.

22 Claims, 5 Drawing Sheets

AUTOMATIC DETECTION OF LOUDSPEAKER CHARACTERISTICS

BACKGROUND

Media devices such as audio/video receivers are often connected to separate speaker arrangements. Media devices may include components to process audio/video and an amplifier to drive speakers. When pairing speakers to a media device, users are often not limited to a particular speaker manufacturer and may choose speakers from a selection of varying quality and characteristics. Speakers, however, may differ greatly in terms of their capabilities. In addition, manufacturers often describe characteristics of speakers in different terms. For example, some manufacturers describe power handling capabilities in terms of continuous power ("RMS"), whereas other manufacturers describe peak power capabilities. This may be problematic, if for instance, a user unknowingly selects an inappropriate speaker for a particular media device. Inappropriate speakers may result in poor audio performance, and worse, may permanently damage the speaker. For example, in cases where the media device is too powerful, the speakers may be damaged. Similarly, if the media device is underpowered, a user may be forced to increase the volume to a point that results in distortion or "clipping."

BRIEF SUMMARY

In an implementation, described is a multimedia device for detecting characteristic information of an audio output device. The multimedia device may include a media interface for connecting to an audio output device via a communication path. For example, the communication path may comprise speaker wire. The speaker wire may comprise two or more electrical conductors and may conform to a particular standardized wire gauge, for example, American Wire Gauge (AWG). The media device may include a processor for retrieving characteristic information and determining an output setting for the audio output device based on the retrieved information. The characteristic information may be stored in a memory of the audio output device and may include information such as power handling capabilities of a speaker. The multimedia device may also include an amplifier for driving the audio output device.

In an implementation, described is a method of detecting characteristics of an audio output device. A media device may establish a communication path to the audio output device. The communication path may include a physical (e.g. speaker wire) or wireless connection. The media device may retrieve characteristic information from the audio output device. In addition to power handling capabilities, the characteristic information may include information relating to impedance, frequency response, sensitivity, dispersion, type, number of drivers, size, enclosure type, and product information. The media device may determine an output setting to the audio output device based on the characteristic information and the media device may drive the audio output device based on the output setting.

In an implementation, the media device may query the audio output device for characteristic information. The query may be a communication signal that may be distinguishable by the audio output device from an audio signal that drives the audio output device. The query may also be indistinguishable by a speaker of the audio output device from an audio signal. In addition, the query may employ a frequency not reproducible as audible sound by a speaker of the audio output device.

In an implementation, described is a multimedia system. The multimedia system may include an audio output device, which includes a speaker and a memory. For example, the audio output device may be a standalone speaker. The multimedia system may also include a media device, which includes a media interface, an amplifier, and a processor. The media device may be coupled to the audio output device through the media interface via a communication path. The processor may retrieve characteristic information from the memory of the audio output device and may determine an output setting for the audio output device based on the retrieved characteristic information. The amplifier may drive the speaker of the audio output device based on the determined output setting.

BRIEF DESCRIPTION OF THE DRAWINGS

The accompanying drawings, which are included to provide a further understanding of the disclosed subject matter, are incorporated in and constitute a part of this specification. The drawings also illustrate implementations of the disclosed subject matter and together with the detailed description serve to explain the principles of implementations of the disclosed subject matter. No attempt is made to show structural details in more detail than may be necessary for a fundamental understanding of the disclosed subject matter and various ways in which it may be practiced.

DETAILED DESCRIPTION

It is desirable that a media device prevents potential damage and optimizes audio output settings to a speaker. Although contemporary audio/video devices such as TVs, Blu-ray players, and other media devices may have their own processors that can communicate with each other, standalone speakers usually do not have their own processing hardware and/or software for communication. Accordingly, it would be beneficial to communicate with an audio output device in order to optimize the output to, for example, a speaker of the audio output device.

Described is the ability for a media device to detect characteristics of an audio output device by retrieving information through a communication path. The media device may optimize output settings to a speaker of the audio output device based on the retrieved information. Speakers may have many different characteristics such as power, impedance, frequency response, etc. With knowledge of the characteristics of the speaker, output settings from the media device may be adjusted appropriately, and an amplifier of the media device, for example, can prevent exceeding the maximum power handling capability of the speaker.

Figure 1:
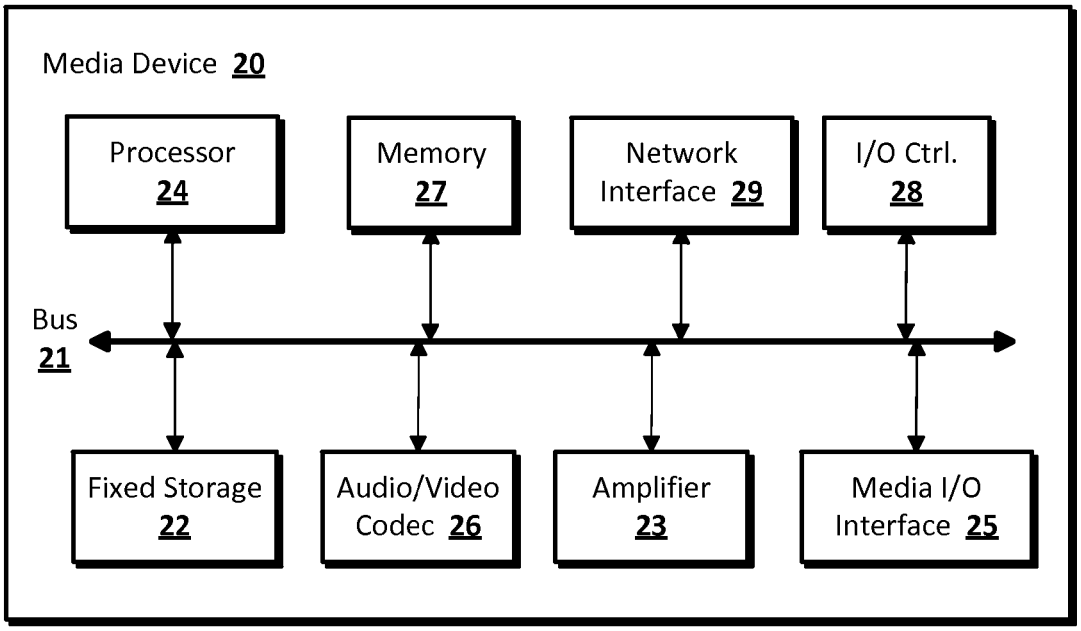
FIG. 1 shows a media device according to an implementation of the disclosed subject matter.

FIG. 1 shows a media device according to an implementation of the disclosed subject matter. The media device 20 includes a bus 21 which interconnects components of the media device 20, such as one or more processors 24 (including digital signal processors), fixed storage 22, an amplifier 23, a media I/O interface 25, an audio/video codec 26, memory 27, an input/output (I/O) controller 28, and a network interface 29.

The bus 21 allows data communication between the processor 24 and the memory 27, which may include random access memory (RAM), read-only memory (ROM), flash memory, and the like. An operating system and application programs may be stored in the memory 27 or may be stored on a fixed storage 22. The fixed storage may be a hard drive, Fibre Channel network, SAN device, SCSI device, and the like. The fixed storage 22 may be integral with the media device 20 or may be separate and accessed through an interface. The fixed storage 22 may also include removable media operative to control and receive an optical disk, flash drive, USB drive, and the like.

Figure 3:
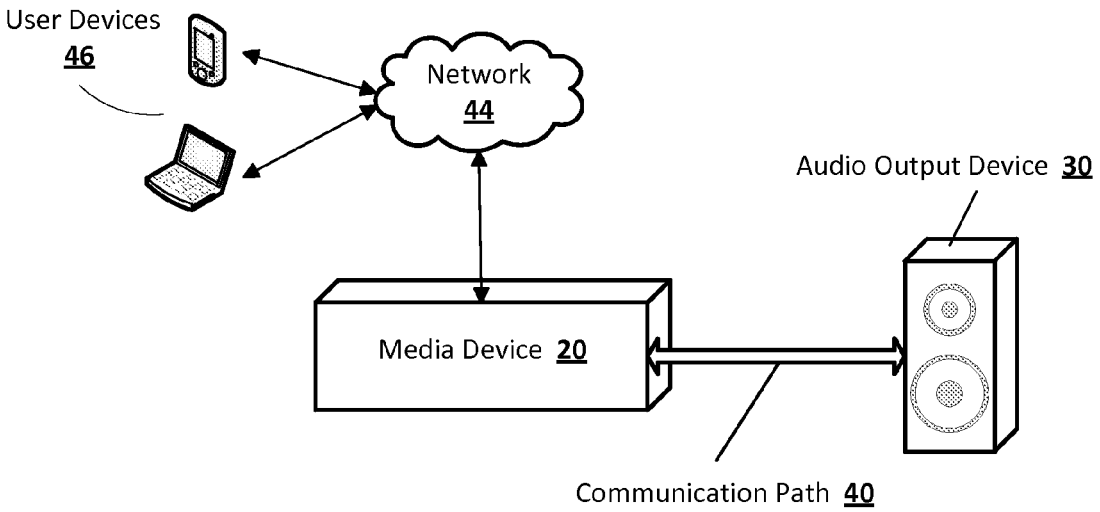
FIG. 3 shows an arrangement of devices according to an implementation of the disclosed subject matter.

A network interface 29 may provide a direct connection to a remote server via a telephone link, to the Internet via an internet service provider (ISP), or a direct connection to a remote server via a direct network link to the Internet via a POP (point of presence) or other technique. The network interface 29 may provide such connection using wireless techniques, including Wi-Fi, digital cellular telephone connection, Cellular Digital Packet Data (CDPD) connection, digital satellite data connection or the like. For example, the network interface 29 may allow the media device 20 to communicate with other user devices 46 via one or more local, wide-area, or other networks, as shown in FIG. 3.

The media device 20 may include a media I/O interface 25, for connecting audio and video components. The interface 25 may include connections for USB, micro USB, HDMI, micro HDMI, composite video, component video, S-video, VGA, DisplayPort, FireWire, S/PDIF via coaxial or optical cables, "RCA" connectors, and the like. The media I/O interface 25 may also include speaker connections for speaker wire, The speaker connections may include various analog connections, multichannel connections (e.g. 5.1, 7.1, including subwoofer connections), and various other connectors for speaker wire, including various binding posts such as banana plugs, pin connectors, bare wire clamps, lug terminals, and the like including proprietary wiring arrangements.

The media device 20 may include an amplifier 23. The amplifier 23 may be an electronic amplifier that amplifies lower power audio signals to a level suitable for driving a speaker. The amplifier 23 may have associated characteristics including a power rating (e.g. 25 Watts, 50 Watts, etc.), number of channels, gain, bandwidth, efficiency, linearity, noise, range, slew rate, rise time, stability, and the like. These characteristics may be optimized based on retrieved characteristic information of a device coupled to the media device 20. The media device 20 may also include components related to the stages that may precede amplification of an audio signal including pre-amplification, tone control, mixing/effects, and the like.

The media device 20 may include an audio/video codec 26 that encodes analog audio as digital signals and decodes digital back into analog. Accordingly, it may include both an Analog-to-Digital converter (ADC) and Digital-to-Analog converter (DAC).

Other devices or components may be part of or connected to the media device 20 (e.g. TV, digital camera, and the like). Conversely, all of the components shown in FIG. 1 need not be present to practice the present disclosure. The components can be interconnected in different ways from those shown. The operation of a media device 20 such as that shown in FIG. 1 is readily known in the art and is not discussed in detail in this application. Code to implement the present disclosure may be stored in a computer-readable storage media such as a memory 27 or fixed storage 22, which may be local or remote.

Figure 2:
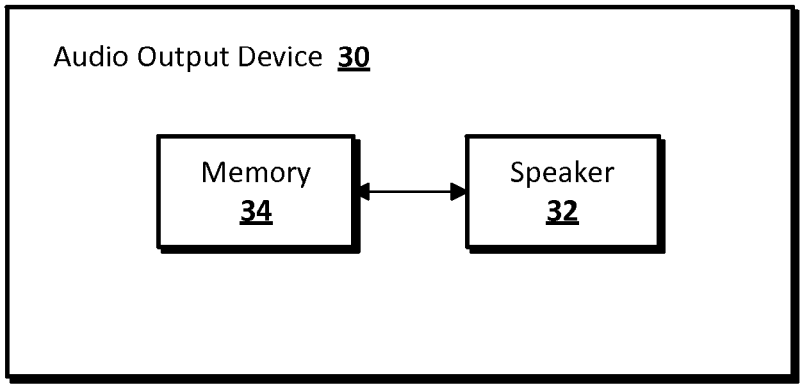
FIG. 2 shows an audio output device according to an implementation of the disclosed subject matter.

FIG. 2 shows an audio output device 30 according to an implementation of the disclosed subject matter. The audio output device 30 may include a speaker 32 for producing audible sound, and a memory 34 for storing characteristic information of the speaker 32. In some cases, the memory 34 may be within the speaker 32. The speaker 32 (or "loudspeaker") may be an electroacoustic transducer that produces sound in response to an electrical audio signal input. The speaker 32 may refer to individual transducers (known as "drivers") or to a speaker system comprising an enclosure including one or more drivers. In some cases, the audio output device 30 may be considered a speaker 32, for example, when the speaker 32 is a speaker system. The speaker system may be a standalone speaker including, for example, a bookshelf or floor standing type speaker. The speaker 32 may employ more than one driver for different frequency ranges. For example, the speaker 32 may include one or more subwoofers (for very low frequencies); woofers (low frequencies); mid-range speakers (mid-range frequencies); and tweeters (high frequencies). The speaker 32 may also include a crossover for separating an incoming audio signal into different frequency ranges for routing to the appropriate driver. A speaker 32 including more than one driver and may, for example, be a two-way speaker (i.e. two drivers), including for example, a woofer and a tweeter, a three-way speaker, including a woofer, a mid-range, and a tweeter, and the like. The speaker 32 may employ various technologies. For example, the speaker 32 may also be an electrostatic, piezoelectric, flat panel, digital, and the like type speaker.

The memory 34 of the audio output device 30 may be a read-only memory (ROM), flash memory, random access memory (RAM), or the like. The memory 34 may store characteristic information of the audio output device 30. The characteristic information may include specifications relating to the speaker 32, or other components or characteristic related to the audio output device. For example, the characteristic information may include speaker or driver type information including, for example, whether the speaker 32 is a full-range, mid-range, woofer, or tweeter type speaker. The characteristic information may also include information regarding the number of drivers and the size of the individual drivers. For example, for cone drivers, the size may be the outside diameter of the basket. The characteristic information may include power handling capabilities typically measured in Watts. The power handling capability information may include measurements for continuous power ("RMS," root mean square), average power, and maximum (or peak) power that a speaker can handle (e.g. maximum input power before damaging the speaker). Characteristic information may include frequency response. Frequency response may include a variance limit measured in decibels (e.g. within ±2.5 dB (decibels)). Characteristic information may include impedance, which may be measured in ohms (e.g. 4Ω (ohms), 8Ω, etc). Characteristic information may also include the number of drivers, baffle or enclosure type (e.g. sealed, bass reflex, etc.), crossover frequencies, thiele/small parameters (e.g. resonance frequency), sensitivity, dispersion, and product information. Product information may include product type, product name, identifiers, manufacturer name, and other information describing the product. Product information may also include manufacturer specific or proprietary information and protocols. The characteristic information may also include preference settings that may be set by a manufacturer, such as equalization settings. This preference information may also be set or updated by a user.

FIGS. 1 and 2 are merely example configurations of a media device 20 and audio output device 30. These configurations are not exhaustive of all the components used or their arrangements within these devices and are intended to be example, non-limiting, configurations of the components. There may, for example, be additional or fewer components and these may interact in various ways known to person of ordinary skill in the art.

FIG. 3 shows an arrangement of devices according to an implementation of the disclosed subject matter. The media device 20 may connect to a network 44. The network may be a local network, wide-area network, the Internet, or any other suitable communication network, and may be implemented on any suitable platform including wired and/or wireless technologies. User devices 46, such as local computers, smart phones, tablet computing devices, and the like may connect to the network 44 and may provide control and display functions for the media device. The media device 20 may also connect to the audio output device 30 via a communication path 40.

The communication path 40 may couple the media device 20 to the audio output device 30. The communication path 40 may be utilized for communicating with the audio output device 30, driving and/or powering the audio output device 30, and the like. The communication path 40 may be a physical or wireless connection. In addition, a combination of both forms (e.g. physical and wireless) may be used for operations described herein (e.g. a wireless connection for communication and a physical connection for driving the audio output device 30).

As described, the communication path 40 may include a physical connection. This physical connection may include speaker wire 72. The speaker wire 72 may comprise two or more electrical conductors and may conform to a particular standardized wire gauge, for example, American Wire Gauge (AWG). The gauge of the wire may depend on the application and/or configuration of the audio output device 30 (e.g. 12 AWG, 14 AWG, etc). The speaker wire 72 may be marked to identify audio signal polarity and may be include some form of color indicators. For example, a red marking may indicate an active or positive terminal and a black marking may indicate an inactive (e.g. reference or return) or negative terminal. The speaker wire 72 may also conform to proprietary manufacturer or branded wiring specifications and types. The communication path 40 may also include audio/video cabling that may connect to the media I/O interface 25 as described herein.

The connection path 40 may include a wireless connection using wireless techniques as described herein. The media device 20 and audio output device 30 may also employ other forms to communicate. For example, quick response (QR) codes and near field communication (NFC) techniques may also be used. For example, NFC components may be associated to each device and the media device 20 may retrieve or receive characteristic information from these components. For example, an audio output device 30 may be placed within proximity of the media device 20 and the media device 20 may determine an output setting based on the retrieved characteristic information. A QR code may be coupled to either the media device 20 or audio output device 30 for retrieving characteristic information. For example, a QR code on the audio output device 30 may be read by the media device 20 or a user device 46 that communicates with the media device 20. The QR code may contain characteristic information in the code itself, or reference, for example, a website with characteristic information or other instructions.

Figure 4:
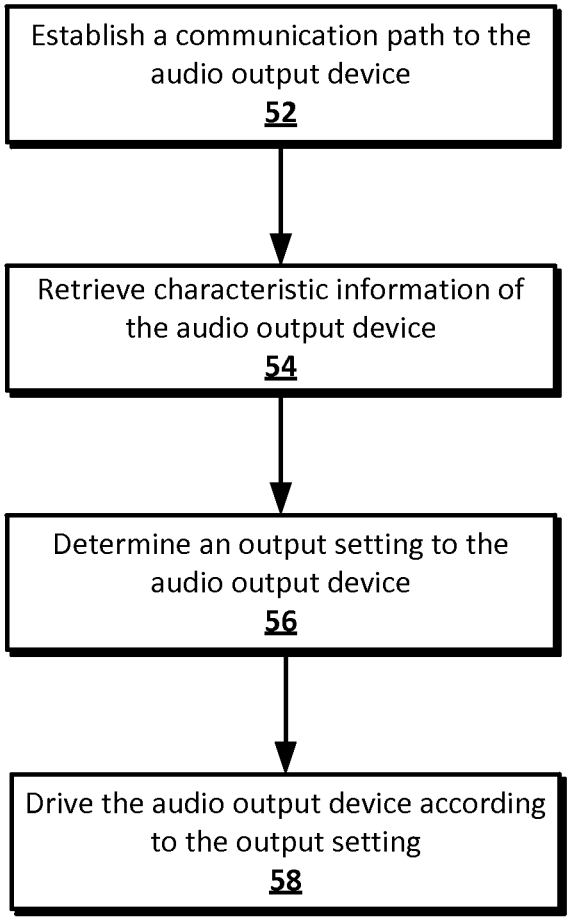
FIG. 4 shows a flowchart of detecting audio output device characteristics by retrieving characteristic information according to an implementation of the disclosed subject matter.

FIG. 4 shows a flowchart of detecting audio output device characteristics by retrieving characteristic information according to an implementation of the disclosed subject matter. A media device 20 may establish a communication path 40 to the audio output device 30 in step 52. Establishing a connection may involve coupling the media device 20 with the audio output device 30 such that the devices are in signal communication with each other. The communication path 40 may be a physical connection, or it may be a wireless connection as described herein. A physical connection may include speaker wire 72 as described herein, or another audio/video cabling connection as described herein. In order to establish a connection, the physical connection (e.g. speaker wire 72) may merely connect the media device 20 to the audio output device 30. For wireless configurations, a connection may be established, for example, when either device sends and acknowledgment identifying the presence of the other device.

In step 54, the media device 20 may retrieve characteristic information of the audio output device 30. This may be accomplished by a processor 24 of the media device 20 interrogating the audio output device 30 by sending a signal through the communication path 40. For example, a user may connect an audio output device 30 having a speaker 32 with a maximum power handling capability of 25 Watts. When the processor 24 of the media device 20 detects the connection, the processor 24 may send a communication signal through the speaker wire to retrieve the maximum power handling capability information. Using the communication signal, the processor reads a memory 34 of the audio output device 30 storing characteristic information. In this example, the processor reads the maximum power handling capability value of the speaker 32 as 25 Watts.

The communication signal used for retrieving characteristic information may be a specific signal type and may include data using a predefined protocol. The communication signal may or may not be distinguishable from an audio signal that is used to drive the audio output device 30. For example, the audio output device 30 may be able to identify the signal as a communication signal instead of an audio signal. In this case, the communication signal may be distinguishable from an audio signal in varying ways. For example, the audio output device 30 may distinguish a communication signal from an audio signal based on characteristics of the signal such as frequency and voltage. Implementations may include employing signal thresholds for distinguishing between a communication signal and an audio signal. For example, the signal may employ a frequency below a specified level as an indication that it is a communication signal.

In addition, implementations may involve the audio output device 30 not distinguishing a communication signal from an audio signal. This provides the benefit of a speaker 32 not needing to process a communication signal differently than an audio signal, and accordingly, it may reduce or eliminate the need for additional hardware and/or software components. For example, the speaker 32 may not identify that a received communication signal is functioning as a communication signal, but the communication signal may employ a sufficiently low frequency that is not reproducible as audible sound by the speaker 32. The signal may, however, be identifiable to other components required for retrieving characteristic information. Another example may include employing a sufficiently high voltage in a communication signal as inputs of the speaker 72 may have low impedance.

Retrieval of characteristic information may occur at predefined times according to a particular application. The process may occur upon the media device 20 detecting that an audio output device 30 has established a connection. The process may occur upon an initialization (e.g. initial installation), a user specified function (e.g. user indicates a new audio output device 30 has been connected), or upon the powering-up of either device. In addition, the media device 20 may detect that the audio output device 30 is a newly connected device, in which case it may initiate a retrieval or query of characteristic information. The media device 20 may also recognize particular devices. The media device 20 may store a unique identifier assigned to an audio output device 30 and may maintain a database storing information for each type of audio output device 30. For example, it may detect that the audio output device 30 was previously connected and may maintain current output settings or may retrieve saved settings.

As described above, characteristic information may be stored in a memory 34 of the audio output device 30. The memory 34 may reside within the audio output device 30 enclosure or cabinet, or may reside externally. The memory 34 may be coupled to the communication path 40 and associated with audio output device 30. Accordingly, a circuit may be formed between the processor 24 of the media device 20 and the memory 34 of the audio output device 30. The memory 34 may be a read-only memory (ROM), or other form a memory described herein. The placement of the memory 34 may vary depending on the type of communication path 40. For example, as shown in the example implementation of FIG. 6, the communication path 40 comprises speaker wire 72 that connects to speaker 32. In the example shown in FIG. 6, the memory 34 may be coupled to the speaker wire 72 at some point before or after the connection to the speaker terminals 74.

Hardware and/or software within the media device 20 may allow the processor 24 to read a memory 34 of the audio output device 30 as if it were reading a memory within the media device 20 itself. In other words, the configuration or protocol used may provide a level of abstraction such that the processor 24 reads the memory 34 without knowledge that the memory 34 may be part of a separate device. The characteristic information may be stored in various forms, for example, as free form text or structured data, although the type of data storage is not limited.

In step 56, the media device 20 may process the characteristic information and determine output settings to the audio output device 30. One output setting may include whether the audio output device 30 is compatible with the media device 20. For example, a compatibility check may verify that the power rating of the speaker 32 is appropriate for the amplifier 23 of the media device 20. If the devices are not compatible, the media device 20 may return an error message, refuse to drive the speaker 32, or notify a user of the incompatibility. If the media device 20 has a display, the message may be displayed on such a display, or the message may be relayed to one of the user devices 46 (e.g. smart phone) over the network 44, or to another display device (e.g. TV) connected to the media I/O interface 25.

The output setting may also include optimizing the output to the audio output device 30. For example, the processor 24 may adjust one or more output settings based on characteristic information of the audio output device 30. These output settings may include equalization settings. The processor 24 may also adjust output settings for an amplifier 23 that may drive a speaker 32 of the audio output device 30. For example, the processor 24 may optimize the gain of the amplifier 23 based on the power handling capabilities of the speaker 32. As described above, the power handling capabilities may include continuous power, average power, and maximum power. For instance, in the example above, the gain of the amplifier may be adjusted in order to prevent exceeding 25 Watts of output in order to prevent damage to the speaker 32. The frequency settings of the amplifier 23 may also be adjusted. In a broad sense, an audio signal to the audio output device 30 may be adjusted in any manner according to retrieved characteristic information.

Output settings may be derived from the characteristic information itself, or in combination with preprogramed logic or user defined settings. In addition, output settings may be supplemented with information from an external source. For example, the characteristic information may include a product, manufacturer, or model identification and the media device 20 may access the network 44 (e.g. Internet) and download, store, or update specific output settings to the particular audio output device 30.

Preferences for output settings may also be stored as profile information in the media device 20. The profile information may be associated to, for example, a user or an audio output device 30. These preferences may be stored as characteristic information in the memory 34 of the audio output device 30 and updated. For example, preferences related to equalization settings may be stored on the audio output device 30 and when the audio output device 30 is connected to another media device 20, the preferences may be imported.

In step 58, the media device 20 may drive the audio output device 30. The driving may be based on characteristic information of the audio output device 30. In operation, for example, an audio signal may be delivered via the communication path 40 to the speaker 32 from the amplifier 23. As described above, the audio signal may be optimized based on the characteristic information.

As described above, the retrieval of characteristic information may include the media device 20 interrogating the audio output device 30, wherein the audio output device 30 is passive and the media device 20 reads characteristic information. In another implementation, the media device 20 may query the audio output device 30, which in turn actively responds to the query and returns the requested characteristic information.

Figure 5:
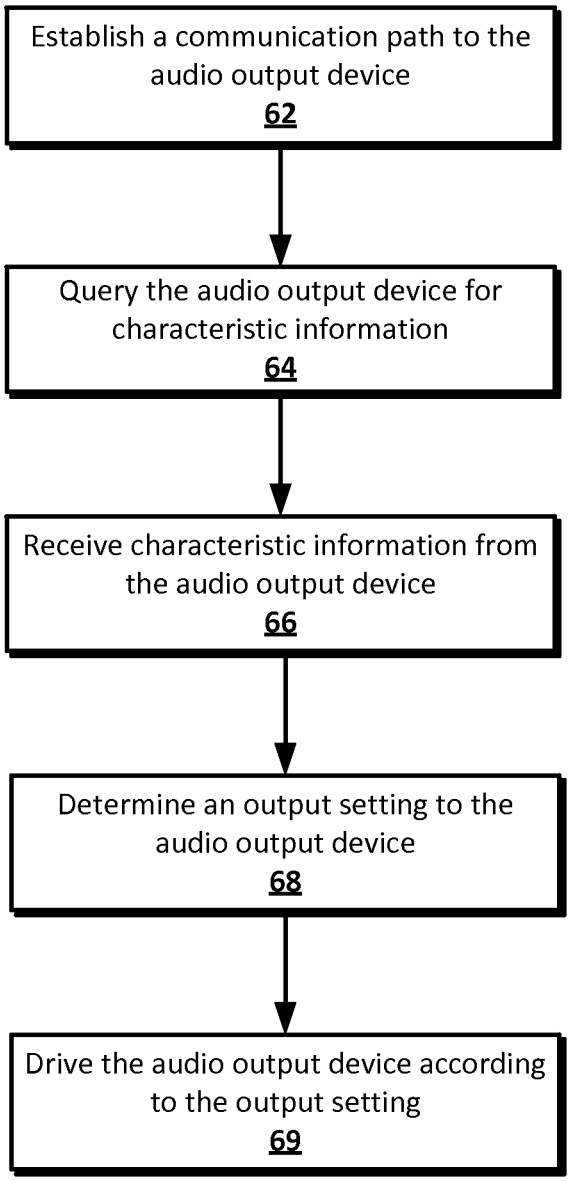
FIG. 5 shows a flowchart of detecting audio output device characteristics by querying the audio output device for characteristic information according to an implementation of the disclosed subject matter.

FIG. 5 shows a flowchart of detecting audio output device characteristics by querying the audio output device for characteristic information according to an implementation of the disclosed subject matter. The media device 20 may establish a communication path 40 to the audio output device 30 in step 62, for example, in a similar manner as described in step 52 of FIG. 4. In step 64, the media device 20 may query the audio output device 30 for characteristic information. The query may include requesting all or some of the characteristic information from the audio output device 30 and may be sent via the communication path 40 using a communication signal as described above. In step 66, the media device 20 may receive characteristic information from the audio output device 30 based on the query of step 64. For example, the media device 20 may detect a speaker wire connection with a new audio output device 30. The media device 20 may then send a query in a communication signal via the speaker wire for a maximum power handling capability of a speaker 32 of the audio output device 30. Hardware and/or software of the audio output device 30, such as a controller, may recognize the signal as a query and respond accordingly. In this example, the controller of the audio output device 30 interprets the query as a maximum power handling capability request and retrieves the maximum power handling capability value stored on a memory 34 of the audio output device 30. After retrieving the maximum power handling capability information, the controller replies by sending this information to the media device 20 through the speaker wire.

In step 68, the media device 20 may process the characteristic information and determine an output setting to the audio output device 30 as described herein. In step 69, the media device 20 may drive the audio output device 30 according to the output setting determined in step 68.

Although the steps shown in FIGS. 4 and 5 are described serially, the steps or operations can be performed by separate elements in conjunction or in parallel. There is no particular requirement that the method be performed in the same order in which this description lists the steps, except where indicated.

Figure 6:
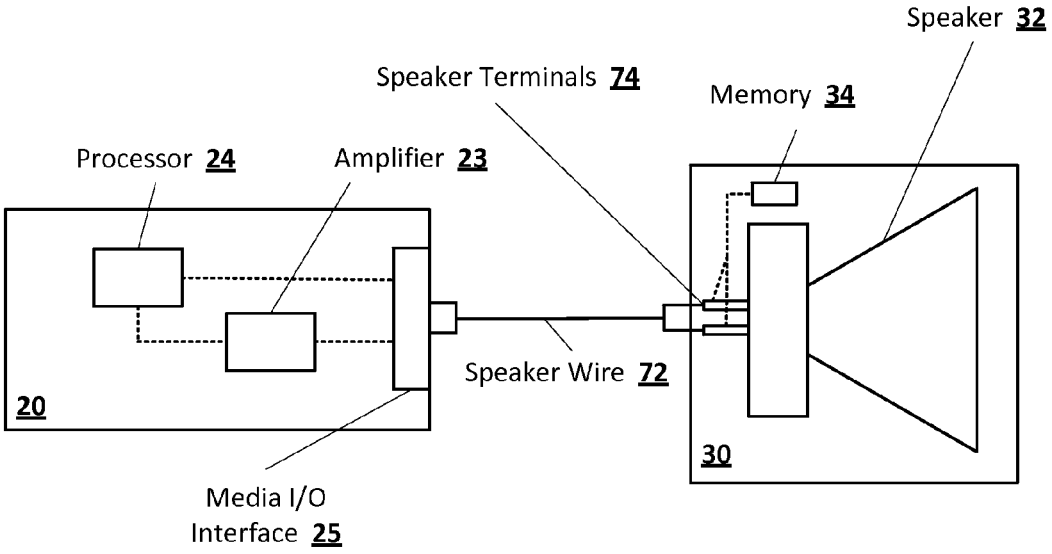
FIG. 6 shows an arrangement of a media device and audio output device connected using speaker wire according to an implementation of the disclosed subject matter.

FIG. 6 shows an arrangement of a media device and audio output device connected using speaker wire according to an implementation of the disclosed subject matter. In the implementation shown in FIG. 6, the communication path 40 comprises speaker wire 72. In the example shown, the media device 20 includes a media I/O interface 25 which interfaces with the audio device 30 via speaker wire 72. Speaker wire 72 may connect to speaker terminals 74 of the speaker 32. The speaker wire 72 may connect directly or indirectly (e.g. binding post, spring clip, or external plugs or clips receiving the speaker wire 72) to the speaker terminals 74. A memory 34 is coupled in some fashion to the speaker wire 72 such that it is also coupled with the media device 20, and may accordingly, connect to the processor 24. In the example shown, the memory 34 may connect directly to the speaker terminals 74, although the memory 34 may also connect directly with the speaker wire 72. The memory 34 may also be coupled to the speaker wire 72 using a circuit board or other intermediary components, paths, or circuits that would be known to a person of ordinary skill in the art.

As shown in the implementation of FIG. 6, the processor 24 of the media device 20 may form a first path to the media I/O interface 25, which connects to the speaker wire 72 that is coupled to the memory 34 of the audio output device 30. The processor 24 may retrieve or query characteristic information from the memory 34 as described herein using this first path. The processor 24 may also form a second path through the amplifier 23 to the media I/O interface 25. This second path may be used by the processor 24 and the amplifier 23 to send an amplified audio signal through the media I/O interface 25 via the speaker wire 72 to the speaker 32. The audio signal may drive the speaker 32 according to characteristic information as described herein. Other components and/or intermediaries using various signal paths may also be used. In addition, other forms of wiring configurations may also be used including bi-amplification setups.

FIG. 6 is merely an example configuration of a media device 20, speaker wire 72, and audio output device 30. This configuration is not exhaustive of all the components used or their arrangements within these devices and is intended to be an example, non-limiting, configuration of the electronics and circuitry. There may, for example, be additional processors and components for storing and retrieving characteristic information and providing and processing an audio signal.

The foregoing description, for purpose of explanation, has been described with reference to specific implementations. However, the illustrative discussions above are not intended to be exhaustive or to limit implementations of the disclosed subject matter to the precise forms disclosed. Many modifications and variations are possible in view of the above teachings. The implementations were chosen and described in order to explain the principles of implementations of the disclosed subject matter and their practical applications, to thereby enable others skilled in the art to utilize those implementations as well as various implementations with various modifications as may be suited to the particular use contemplated.

The invention claimed is:

1. A multimedia device, comprising:

a media interface for connecting to an audio output device via a communication path;

an amplifier for driving the audio output device; and a processor, the processor configured to:

retrieve in a first communication signal, via the communication path, an identifier of the audio output device;

determine, based on the retrieved identifier, that the audio output device has not been previously connected to the multimedia device;

request, in response to determining that the audio output device has not been previously connected, characteristic information from the audio output device; and receive, from a second communication signal actively sent by the audio output device and via the communication path, the requested characteristic information of the audio output device; and determine an output setting for the audio output device based on the characteristic information, wherein the communication path comprises speaker wire.

2. The device of claim 1, wherein the characteristic information of the audio output device is stored in a memory of the audio output device.

3. The device claim 2, wherein the memory is within an enclosure of the audio output device.

4. The device of claim 1, wherein the characteristic information includes a power handling capability of the audio output device.

5. The device of claim 1, wherein the first communication signal is distinguishable by the audio output device from an audio signal that drives the audio output device.

6. The device of claim 1, wherein the first communication signal is indistinguishable by a speaker of the audio output device from an audio signal that drives the speaker and the first communication signal employs a frequency not reproducible as audible sound by the speaker.

7. The device of claim 1, wherein the output setting comprises a compatibility of the audio output device with the amplifier.

8. The device of claim 1, wherein the characteristic information includes information relating to at least one of an impedance, frequency response, sensitivity, dispersion, type, number of drivers, size, enclosure type, and product information.

9. The device of claim 1, wherein the speaker wire comprises a stranded two conductor wire.

10. The device of claim 1, wherein the media interface comprises a first and a second speaker wire binding post.

11. The device of claim 1, wherein the speaker wire conforms to a standardized wire gauge.

12. The device of claim 11, wherein the standardized wire gauge is an American wire gauge (AWG) standard and a gauge of the speaker wire conforms to one of a 10 AWG standard, 12 AWG standard, 14 AWG standard, and a 16 AWG standard.

13. A method of detecting characteristics of an audio output device, comprising:

establishing a communication path to the audio output device;

retrieving in a first communication signal, via the communication path, an identifier of the audio output device;

determining, based on the retrieved identifier, that the audio output device has not been previously connected to the multimedia device;

requesting, in response to determining that the audio output device has not been previously connected, characteristic information from the audio output device; and receiving, from a second communication signal actively sent by the audio output device and via the communication path, the requested characteristic information of the audio output device; and determining an output setting for the audio output device based on the characteristic information, wherein the communication path comprises speaker wire.

14. The method of claim 13, wherein the characteristic information of the audio output device is stored in a memory of the audio output device.

15. The method of claim 14, wherein the memory is within an enclosure of the audio output device.

16. The method of claim 13, wherein the characteristic information includes a power handling capability of the audio output device.

17. The method of claim 13, wherein the first communication signal is distinguishable by the audio output device from an audio signal that drives the audio output device.

18. The method of claim 13, wherein the first communication signal is indistinguishable by a speaker of the audio output device from an audio signal that drives the speaker and the first communication signal employs a frequency not reproducible as audible sound by the speaker.

19. The method of claim 13, wherein the output setting comprises a compatibility of the audio output device with the amplifier.

20. The method of claim 13, wherein the characteristic information includes information relating to at least one of an impedance, frequency response, sensitivity, dispersion, type, number of drivers, size, enclosure type, and product information.

21. A multimedia system, comprising:

an audio output device including a speaker and a memory; and a media device including a media interface for connecting to the audio output device via a speaker wire, an amplifier for driving the speaker, and a processor, the processor configured to:

retrieve in a first communication signal, via the speaker wire, an identifier from the memory of the audio output device;

determine, based on the retrieved identifier, that the audio output device has not been previously connected to the multimedia device;

request, in response to determining that the audio output device has not been previously connected, characteristic information from the audio output device; and receive, from a second communication signal actively sent by the audio output device and via the speaker wire, the requested characteristic information of the audio output device; and determine an output setting for the amplifier based on the characteristic information.

22. The system of claim 21, wherein the audio output device is a standalone speaker.

* * * * *